United States Patent [19]

Schmidt et al.

[11] Patent Number: 4,494,265

[45] Date of Patent: Jan. 22, 1985

[54] METHOD OPERATING A TUNNEL-TYPE BATCH WASHING MACHINE

[75] Inventors: Herbert Schmidt, Arolsen; Hans Steinort, Hildesheim-Itzum, both of Fed. Rep. of Germany

[73] Assignee: Senkingwerk GmbH KG, Hildesheim, Fed. Rep. of Germany

[21] Appl. No.: 168,458

[22] Filed: Jul. 10, 1980

[30] Foreign Application Priority Data

Jul. 11, 1979 [DE] Fed. Rep. of Germany ..... 2927874

[51] Int. Cl.[3] ..... D06F 21/02; D06F 37/08

[52] U.S. Cl. ..... 8/159; 68/16; 68/58; 68/143

[58] Field of Search ..... 68/16, 27, 58, 143, 68/145, 158; 8/159

[56] References Cited

U.S. PATENT DOCUMENTS

| | | | |
|---|---|---|---|
| 2,056,803 | 10/1936 | Failing | 68/158 X |
| 3,103,802 | 9/1963 | Streich | 68/158 X |
| 3,707,858 | 1/1973 | Gulzow et al. | 68/143 |
| 3,969,913 | 7/1976 | Schaper | 68/143 |
| 4,210,004 | 7/1980 | Stoll et al. | 68/58 X |

*Primary Examiner*—Philip R. Coe

*Attorney, Agent, or Firm*—Karl F. Ross; Herbert Dubno

[57] ABSTRACT

A tunnel-type batch washing machine has an outer tunnel-forming housing tube centered on a horizontal axis and provided internally with a helical wash screw rotatable in the tube about the axis and having a plurality of flights defining axially spaced compartments. A generally cylindrical sleeve is fixed to this screw and is coaxially received within the tube between the screw and the tube. A treatment liquid is flowed axially in one direction through the housing and respective batches of articles to be washed are held in the compartments between the flights. For washing the screw is oscillated back and forth about the axis through substantially more than 360° to agitate the articles in the liquid. Periodically the screw is rotated about the axis through substantially more than 720° in a rotation direction to advance the batches axially opposite the direction of liquid flow. The sleeve is formed at one of the compartments with a through-going aperture and the tube has in radial alignment with this one compartment a pocket provided with a heating apparatus. As the aperture is rotated into alignment with the pocket, liquid exchange takes place through the aperture to heat up liquid inside the sleeve.

4 Claims, 27 Drawing Figures

METHOD OPERATING A TUNNEL-TYPE BATCH WASHING MACHINE

FIELD OF THE INVENTION

The present invention relates to a method of operating a tunnel-type batch washing machine.

BACKGROUND OF THE INVENTION

A tunnel-type batch washing machine has an outer housing tube that is centered on a horizontal axis and that has an upstream intake end and a downstream output end. Provided inside this tube is a so-called washing screw having an axial succession of flights defining respective compartments inside the tube. A sleeve may be fixed to the screw between same and the tube. Normally clear water is introduced at the downstream end, and the tube is pitched slightly toward the upstream end so that this liquid will flow through it and the sleeve toward this upstream end.

In use the screw and sleeve are oscillated back and forth through less than 360° and are periodically rotated in one direction only through more than 360°. In this manner individual batches or loads of laundry or the like that are held in the individual compartments are agitated during the back-and-forth oscillation of the screw, and are advanced sequentially downstream from one compartment to the next during the rotation through more than one revolution. In this manner it is possible to wash or otherwise liquid-treat large quantities of articles while maintaining the articles in separate discrete batches.

The main disadvantage with such washers is that they do not clean very effectively. This is normally due to the inadequate agitation during oscillation of the screw, although this problem can be somewhat alleviated by forming the screw with a stepped washboard-type surface as described in the commonly owned and jointly filed application Ser. No. 168,459. Even with such expedients, it is frequently necessary to use extremely strong cleansing agents to obtain adequate results. Such agents frequently are so strong that they damage the article being cleaned. Furthermore it is difficult with such machines to maintain the water sufficiently hot, as even if the water is introduced at a very high temperature, it quickly cools down so that by the time the spent rinse water has reached the upstream washer zones it is relatively cool.

OBJECTS OF THE INVENTION

It is therefore an object of the present invention to provide an improved method of operating a tunnel-type washing machine which method substantially increases the cleaning power of the machine.

Yet another object is to prevent the water inside the machine from becoming too cool during the wash cycle.

SUMMARY OF THE INVENTION

These objects are attained in part through the expedient of oscillating the screw and its sleeve through substantially more than 360° during the oscillation cycles, as distinguished from the conveying cycles. It has been found that rotation through 90° or less hardly moves the articles being washed at all, but that rotation through more than 360°, and up to 720° is possible according to this invention, which has an extremely good agitating effect and makes the articles substantially cleaner than has hitherto been considered possible. Admittedly such oscillation does entail considerable axial displacement of the articles being washed, nonetheless the batches remain completely separate so that no harm results.

According to a further feature of this invention the sleeve surrounding and fixed to the screw is formed at one of the compartments over a limited angular zone with a perforated region. In addition the housing tube surrounding the sleeve and screw is formed at this one compartment with an upwardly open pocket provided integrally with means for heating water or other liquid in it. In this manner as the perforated region aligns with the pocket liquid exchange between the hot liquid in the pocket and the cool liquid in the sleeve is possible, with concomitant heating of the liquid in the sleeve. This one compartment is normally at the so-called clear-wash zone of the machine.

According to further features of this invention the sleeve is provided internally at the perforated region with a perforated wall or screen extending angularly to both sides substantially beyond the perforated region. This screen or the like therefore prevents any articles of clothing or the like not only from passing through the perforations of this region into the pocket, but also ensures that such articles of clothing or the like do not block the perforations of this region for most effective liquid exchange at the perforated region. According to this invention the perforated regions extends relative to the axis of the device through an angle of approximately 90° whereas the screen extends through an angle at least twice as large, in one embodiment according to this invention equal to 270°.

According to this invention the pocket may be provided with an electrical resistance-type heater. It is also possible for maximum sterilization of the wash to provide the pocket with a live-steam jet, which can rapidly and effectively heat any water in the pocket and at the same time can sterilize the garments or the like in the one compartment.

SPECIFIC DESCRIPTION

Figure 1A:
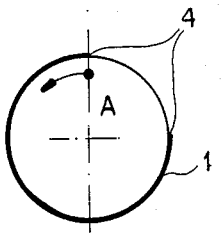
FIGS. 1*a*–1*g* are axial cross sections showing the sleeve and screw of this invention at various successive phases during one half of an oscillation.
Figure 1B:
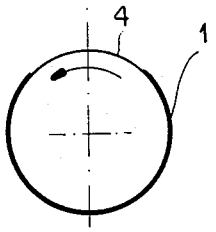
Figure 1C:
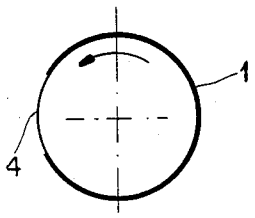
Figure 1D:
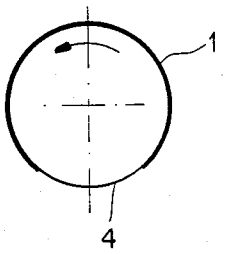
Figure 1E:
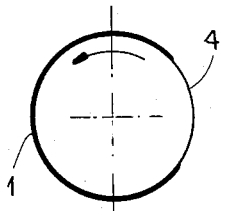
Figure 1F:
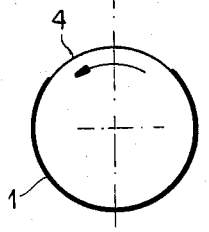
Figure 1G:
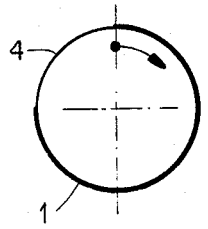
Figure 1H:
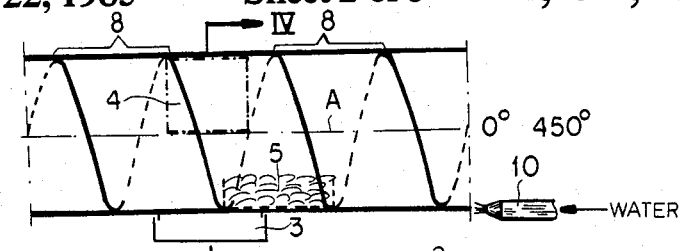
FIGS. 1*h*–1*n* are axial sections corresponding respectively to the cross sections of FIGS. 1*a*–1*g;*
Figure 1I:
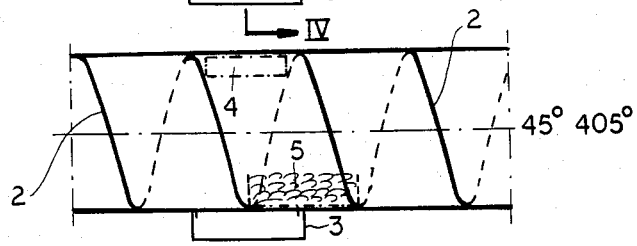
Figure 1J:
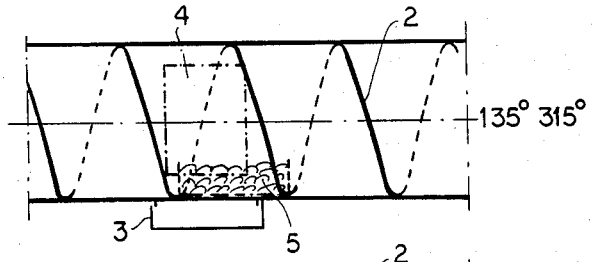
Figure 1K:
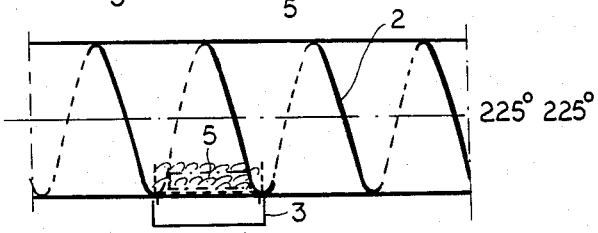
Figure 1L:
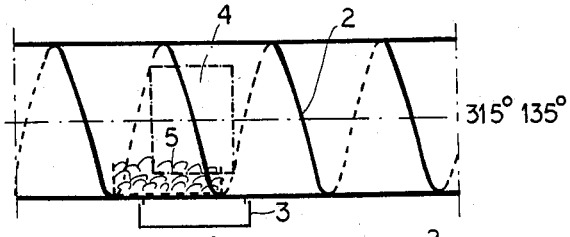
Figure 1M:
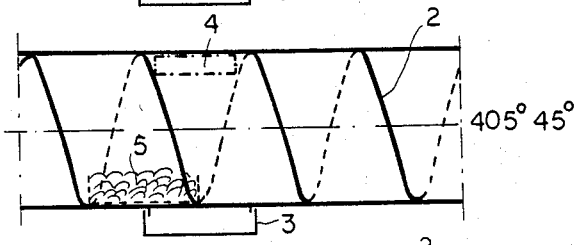

As seen in FIGS. 1*a* and 1*h* the washing machine according to this invention has a sleeve 1 centered on axis A and formed with a perforated zone 4 extending over a 90° quadrant. Fixed inside this sleeve 1 is a helical wash screw 2 of the type described in the above-cited copending application which sub-divides the interior of the sleeve 1 into a plurality of axially spaced compartments 8.

Figure 2:
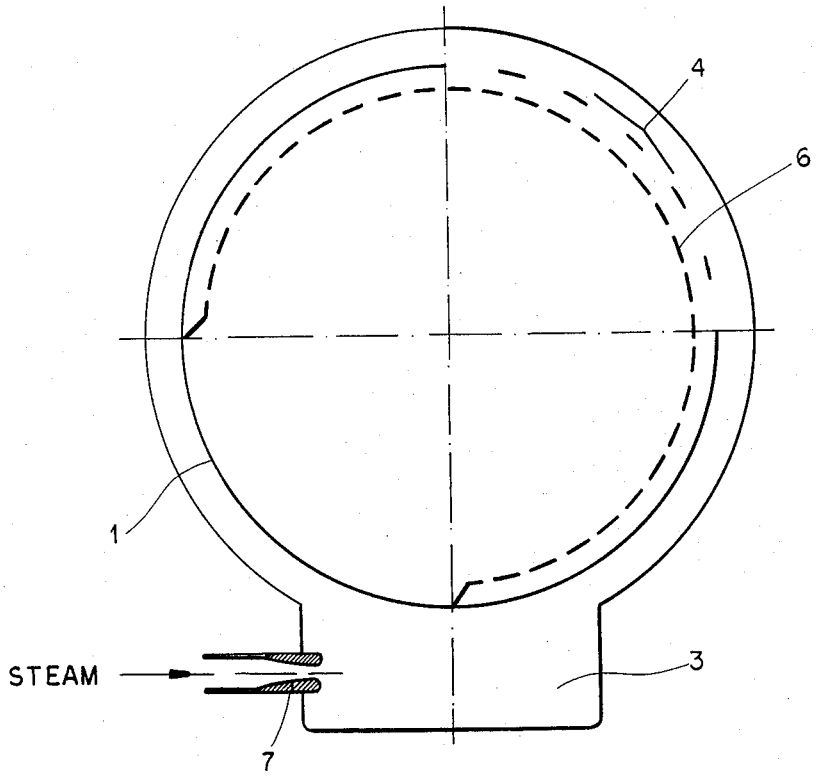
FIGS. 2 and 3 are large-scale views of the structure shown in FIGS. 1*d* and 1*f*, respectively.
Figure 3:
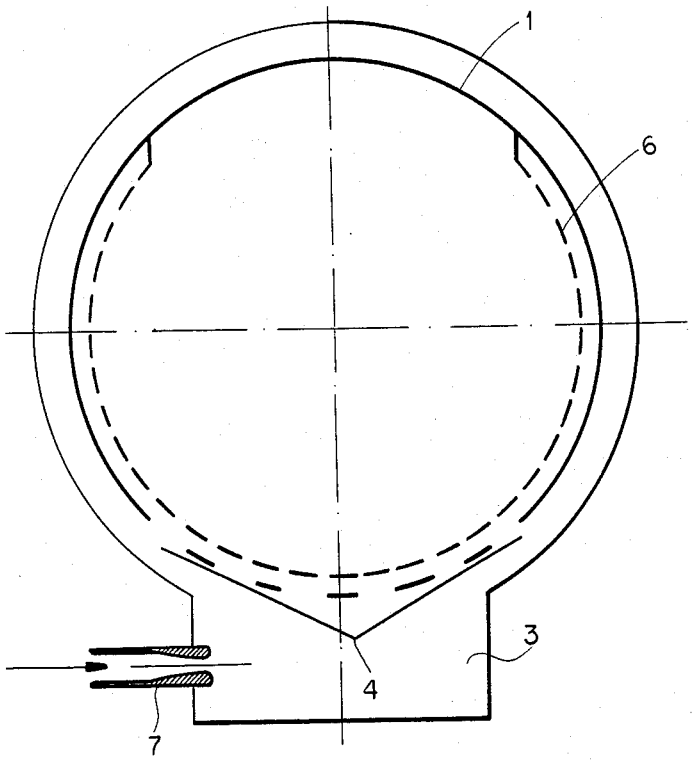
Figure 4A:
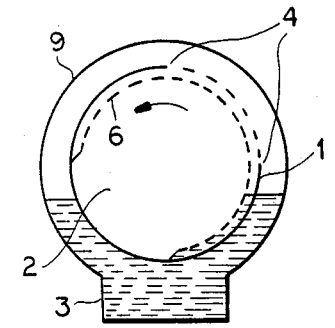
FIGS. 4*a*–4*k* are views taken along line IV—IV of FIG. 1*h* showing the arrangement according to this invention in successive operational positions.
Figure 4B:
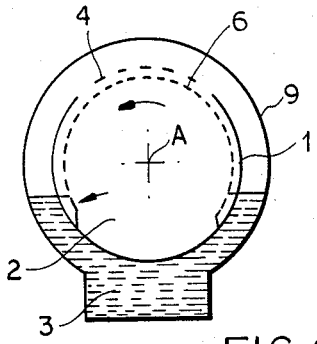
Figure 4C:
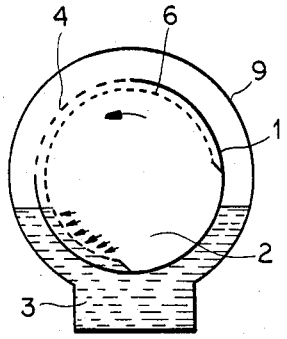
Figure 4D:
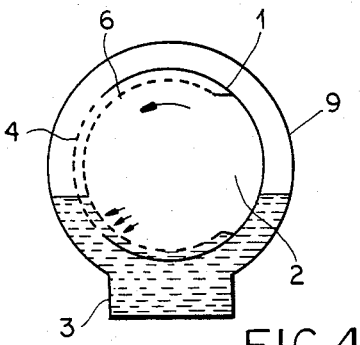
Figure 4E:
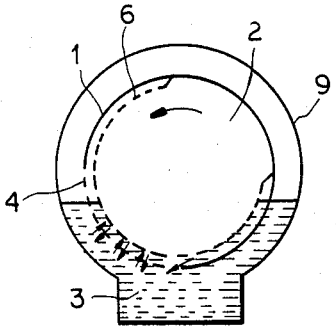
Figure 4F:
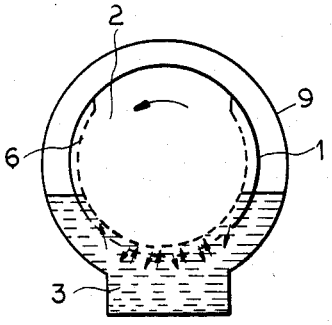
Figure 4G:
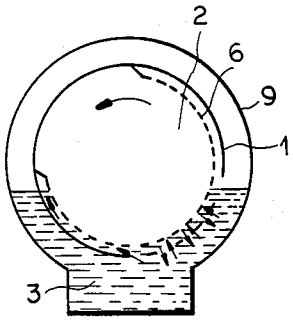
Figure 4H:
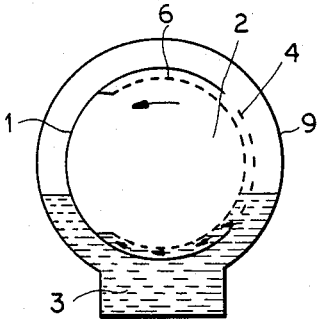
Figure 4I:
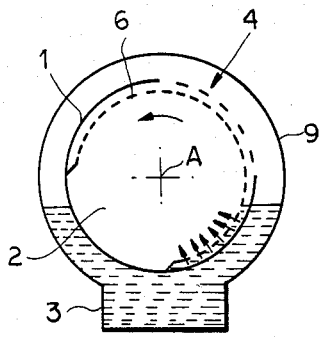
Figure 4J:
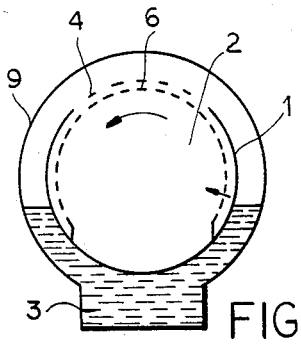
Figure 4K:
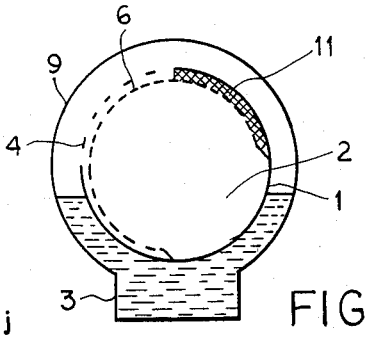

Surrounding the sleeve 1 and screw 2 as seen in FIGS. 4*a*–4*k* is a housing tube 9 formed underneath one of the regions or zones 8 with an upwardly open pocket 3 provided as seen in FIG. 2 with a steam-injection jet 7. The sleeve 1 is provided internally at the compartment of the perforated region 4 above the pocket 3 with an internal wall or screen 6 which extends over 270° centered on the perforated region 4 so that it extends 90° to each side of this perforated region 4.

Under normal use liquid is introduced, as by means of a nozzle 10, at the downstream end of the sleeve 1 and batches 5 of articles to be washed are introduced at the upstream end each time the compartment 8 at the furthest upstream end is empty. A cleansing agent or detergent may be introduced at this upstream end or several zones 8 downstream from the upstream end, but nonetheless upstream from the pocket 3.

Figure 1N:
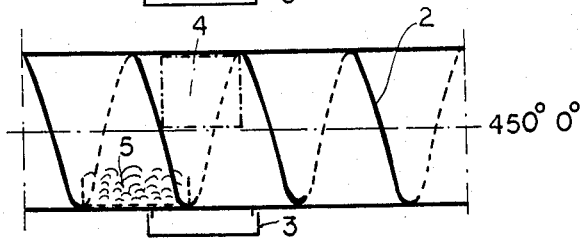

According to this invention the articles in the batches 5, one of which is in each zone 8 although only one such batch 5 is shown for clarity of view, are washed by oscillation of the sleeve 1 with the auger or screw 2 through 450° between the positions shown in FIGS. 1*a* and 1*h* and the positions shown in FIGS. 1*g* and 1*n*. This has the effect of axially displacing the batches 5 back and forth from one compartment 8 to the next, while ensuring excellent agitation and extremely good cleansing action.

As best seen in FIGS. 4*a*–4*k* this also has the effect of exchanging part of the liquid inside the tube 1 with the heated liquid inside the pocket 3. Thus as the sleeve 1 is rotated into the position of FIG. 4*d* liquid will flow between the interior of the sleeve 1 and the pocket 3, and this liquid exchange will continue until the position of FIG. 4*i*, whereupon the interior and exterior of the sleeve 1 are again separated from each other since the perforated zone 4 is above the liquid level at the pocket 3, which liquid level lies well below the axis A of the system. It is noted that even if the batch of clothing washed completely blocks the interior of the screen 6 and substantially prevents fluid flow through it except when the arrangement is inverted in the positions of FIGS. 4*a*–*c* and 4*i*–*k*, the hatched region shown at 11 in FIG. 4*k* will nonetheless become filled with the hot liquid from the pocket 3 to ensure some heating up of the water inside the sleeve 1.

Thus with the system of the instant invention extremely good agitation is obtained by the relatively long oscillation stroke, here of 45°, of the sleeve and conveyor screw. At the same time the water is reheated at the clear-wash location along the machine. Otherwise the water, by the time it arrives at the location, has normally cooled so substantially as not to be able to clean effectively.

We claim:

1. A method of operating a tunnel-type batch washing machine having an outer tunnel-forming housing tube centered on a horizontal axis and a helical wash screw rotatable in said tube about said axis and having a plurality of flights defining axially spaced compartments, said method comprising the steps of:

flowing a liquid axially in one direction through said housing;

holding respective batches of articles to be washed in said compartments between said flights;

oscillating said screw back and forth about said axis through substantially more than 360° and thereby agitating said articles in said liquid;

periodically rotating said screw about said axis through substantially more than 720° in a rotational direction to advance said batches axially opposite said one direction.

2. The method defined in claim 1 wherein said screw is oscillated back and forth through between 360° and 720°.

3. The method defined in claim 2 wherein said screw is oscillated back and forth through about 450°.

4. The method defined in claim 1 wherein said screw carries a generally cylindrical sleeve fixed to said screw and coaxially received within said tube between said screw and said tube, said sleeve having at one of said compartments at least one throughgoing aperture and said tube having in radial alignment with said one compartment a pocket filled with hot liquid, said method further comprising the step of rotating said aperture past said pocket and thereby exchanging said hot liquid in said pocket with the liquid in said sleeve.

* * * * *